US005410963A

United States Patent [19]

Steadman

[11] Patent Number: 5,410,963

[45] Date of Patent: May 2, 1995

[54] BACKING BLANKET FOR PRINTING PLATES

[75] Inventor: Glynn R. Steadman, Chicago, Ill.

[73] Assignee: Squarmount, Inc., Chicago, Ill.

[21] Appl. No.: 237,383

[22] Filed: May 3, 1994

[51] Int. Cl.[6] ..... B41F 13/10

[52] U.S. Cl. ..... 101/376; 101/382.1

[58] Field of Search ..... 101/369, 376, 401.1, 101/401.2, 379, 382.1, DIG. 36; 428/909

[56] References Cited

U.S. PATENT DOCUMENTS 2,033,705 3/1936 Hacker .
2,680,405 6/1954 Faeber et al. .
3,096,713 7/1963 McLaughlin, Jr. .
3,119,330 1/1964 Kunetka ..... 101/376
3,703,864 11/1972 Bradford ..... 101/369
3,858,507 1/1975 Owren et al. .
4,047,481 9/1977 Saunders .
4,403,548 9/1983 Faller .
4,724,181 2/1988 Mingenbach .
4,766,811 8/1988 Linska .
4,871,631 10/1989 Pieper et al. .

*Primary Examiner*—Ren Yan
*Attorney, Agent, or Firm*—Lockwood, Alex, FitzGibbon & Cummings

[57] ABSTRACT

A backing blanket for mounting and supporting resilient rubber-like printing plates on the printing rollers or drums of printing presses. The backing blanket comprises a semi-rigid flexible sheet of transparent or translucent plastic such as PVC. The underside of the plastic sheet which goes next to the press roll or drum is smooth and has a grid printed thereon. The top surface of the plastic sheet has a matted or embossed surface which facilitates the spreading of adhesive thereon to which the printing plate is adhered and also facilitates the escape of air and prevents formation of pockets in the surface of the printing plate.

2 Claims, 1 Drawing Sheet

FIG. 1
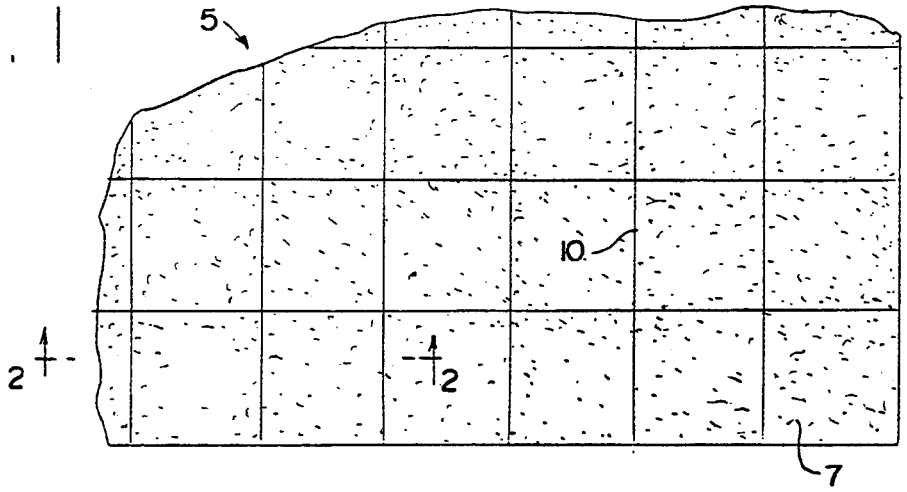
FIG. 2
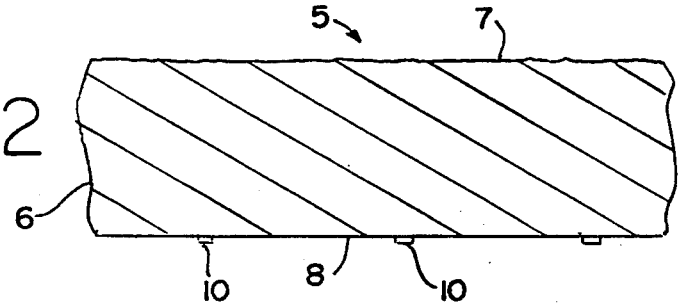
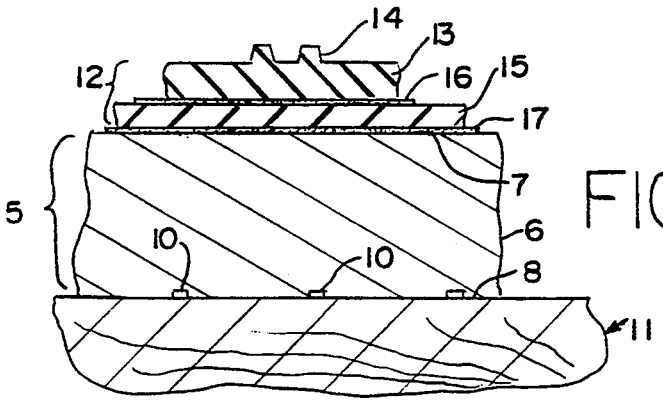
FIG. 3
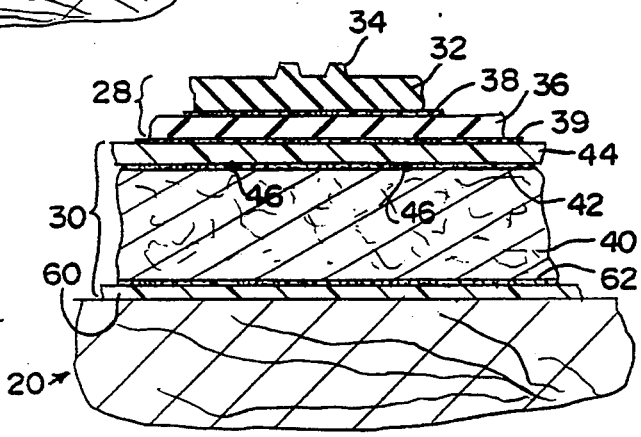
FIG. 4
PRIOR ART

BACKING BLANKET FOR PRINTING PLATES

BACKGROUND AND DESCRIPTION OF THE INVENTION

1. Field of the Invention

This invention relates to innovations and improvements and innovations in backing or print blankets for use in mounting resilient rubber-like printing plates onto the print drums or rollers of printing presses.

2. Description of the Related Art

Backing blankets or backing structures, also known as print blankets, are commonly used in mounting rubber printing plates onto the printing drums or printing rollers of printing presses. U.S. Pat. No. 3,119,330 dated Jan. 28, 1964 to Lawrence S. Kunetka discloses a backing structure or print blanket that has been successfully used for mounting rubber printing plates onto printing rollers or drums. The backing structures or print blankets of U.S. Pat. No. 3,119,330 is a composite of a sheet of latex impregnated paper board having protective transparent films laminated to its opposite surfaces. One of the surfaces is printed with a grid before the protective film is laminated thereto. The grid will be visible through the protective film and assist in mounting the backing blanket on the print roll or drum and also assist in the mounting of a rubber printing plate in the proper location and orientation on the press drum or roller.

SUMMARY OF THE INVENTION

While backing blankets or print blankets of the composite construction disclosed in U.S. Pat. No. 3,119,330 have served satisfactorily for a number of years in printing establishments, they are not capable of standing up under the conditions imposed in the high speed presses that are now in common use. Accordingly, the object of the present invention, generally stated, is the provision of improved backing or print blankets for mounting resilient rubberlike printing plates onto the drums or rollers of high speed printing presses which backing or print blankets are economical to produce, easily installed and long-wearing and which will withstand the severe conditions imposed in modern high speed printing presses.

Certain more specific objects of the invention will be apparent to those skilled in the art in light of the following detailed description of the invention in connection with the accompanying drawings wherein:

BRIEF DESCRIPTION OF THE DRAWINGS

FIG. 1 is a fragmentary plan view of a corner portion backing or print blanket embodying the invention;

FIG. 2 is a fragmentary cross-sectional view on magnified scale taken on line 2—2 of FIG. 1;

FIG. 3 is a fragmentary, cross-sectional view on a magnified scale illustrating use of the backing blanket of FIGS. 1 and 2 in mounting a rubber printing plate on a printing roller or drum; and FIG. 4 is a view similar to FIG. 3 but illustrating the prior art and corresponding to FIG. 3 of U.S. Pat. No. 3,119,330.

DESCRIPTION OF THE PREFERRED EMBODIMENT

Referring first to FIGS. 1 and 2, a backing or print blanket is indicated generally therein at 5 consisting of a sheet of plastic such as PVC 6 having a matted or embossed top surface 7 and a smooth underside surface 8 on which a grid 10 has been printed. The PVC sheet 6 is either transparent or translucent so as to allow the grid 10 to be viewed from the top surface 7. The important purpose and function of the matted surface 7 will be explained in connection with FIG. 3. While PVC (polyvinylchloride) in the form of a semi-rigid sheet has proven to be a satisfactory plastic material for forming the backing member 5, other translucent or transparent plastics may be used such as Mylar.

Referring to FIG. 3, the backing or print blankets of FIGS. 1 and 2 is shown mounted on a printing roller or drum 11. As is well understood in the art, the backing blanket 5 may be installed on the roller or drum 11 so as to cover its entire surface as illustrated in FIGS. 4 and 5 of U.S. Pat. No. 3,119,330 or it may be installed so as to cover only a portion of the surface as illustrated in FIGS. 1 and 2 of U.S. Pat. No. 3,119,330.

After the backing blanket or sheet 5 has been installed on the roller or drum 11, a rubber or resilient rubber-like printing plate of known type indicated generally at 12 is mounted on the top matted surface 7 utilizing the grid 10 as a means of accurately locating and orienting the printing plate 12 in the precise position required. The printing plate 12 may be of conventional construction and comprise a sheet 13 of rubber or rubber-like material the upper surface of which has been cut or otherwise provided with a printing face of type 14. The rubber sheet 13 is affixed to a thin sheet 15 of rubber by means of a pressure sensitive adhesive indicated at 16.

The printing plate 12 is secured to the matte surface 7 of the backing or print blanket 5 by means of a layer of adhesive indicated at 17. The matte finish both facilitates the spreading of the adhesive 17 and promotes the escape of air so as to prevent pockets from forming in the surface of the printing plate 12.

Since the grid 10 is located on the underside of the PVC sheet 6, it is not subject to wear and thereby allows repeated mounting and remounting of printing plates on the matted surface 7. Further, since the sheet 6 is a single ply there is no problem of delamination even in use with the larger and heavier printing plates now encountered.

As stated, FIG. 4 corresponds to FIG. 3 of U.S. Pat. No. 3,119,330. It shows a composite backing blanket 30 mounted on a printing roller 60 and a rubber printing plate 28 mounted on the outer surface of the blanket 30. The printing plate 28 may be of the same construction as printing plate 12 of FIG. 3 and is shown in FIG. 4 mounted on the outer surface of the backing member 30 by means of a layer of adhesive indicated at 39.

The backing blanket 30 is a composite of a sheet of latex impregnated paper board 40 having a transparent film 44 laminated to its outer or top surface and a transparent film 60 laminated to its underside. Prior to lamination of outer or top protective film 44 the outer or top surface of the backing blanket or print blanket 30 is printed with a grid which is indicated at 46.

Since the grid 46 has to be located on the outer surface of the opaque backing blanket 30 in order to be visible, the transparent film 44 is required in order to protect the grid 46 from wear due to mounting and remounting of printing plates. In contrast by forming the backing blanket or support 5 of FIGS. 1–3 from a sheet of transparent or translucent plastic in accordance with the present invention, the backing blanket 5 is able to provide the dual advantages of a matted outer or top surface and a protected grid 10 on the smooth underside of the blanket.

What is claimed is:

1. A unitary backing blanket for a resilient rubber-like printing plate which consists of a flexible semi-rigid translucent or transparent plastic sheet having a smooth underside surface with a grid pattern thereon and a matted or embossed top surface to which a resilient rubber-like printing plate may be adhesively secured, said grid pattern being viewable through said matted top surface.

2. The backing structure of claim 1 wherein said plastic sheet is a single ply of PVC.

* * * * *